US012643033B2

(12) United States Patent
Tsao

(10) Patent No.: US 12,643,033 B2
(45) Date of Patent: Jun. 2, 2026

(54) ROULETTE DEVICE

(71) Applicant: Chung-Piao Tsao, Taipei City (TW)

(72) Inventor: Chung-Piao Tsao, Taipei City (TW)

( * ) Notice: Subject to any disclaimer, the term of this patent is extended or adjusted under 35 U.S.C. 154(b) by 917 days.

(21) Appl. No.: 17/936,419

(22) Filed: Sep. 29, 2022

(65) Prior Publication Data

US 2024/0108971 A1 Apr. 4, 2024

(51) Int. Cl.
*A63F 5/02* (2006.01)
*A63F 5/00* (2006.01)

(52) U.S. Cl.
CPC ..... *A63F 5/02* (2013.01); *A63F 5/007* (2013.01)

(58) Field of Classification Search
CPC ..... A63F 5/00; A63F 5/02; A63F 5/007
See application file for complete search history.

(56) References Cited

U.S. PATENT DOCUMENTS 1,340,304 A * 5/1920 Taussig ..... A63F 3/04 273/142 E
1,468,984 A * 9/1923 Weaver ..... A63F 5/0088 273/142 G
1,851,628 A * 3/1932 Herrick ..... A63F 7/0628 273/142 E
2,087,555 A * 7/1937 Simpson ..... A63F 5/02 434/167
5,222,736 A * 6/1993 Workman ..... A63F 5/02 273/123 R
9,999,830 B2 * 6/2018 Fisher ..... A63F 5/02
10,894,203 B2 * 1/2021 Conte ..... G07F 17/322
2024/0108971 A1 * 4/2024 Tsao ..... A63F 5/007

FOREIGN PATENT DOCUMENTS

GB 2523559 A * 9/2015 ..... A63F 5/0076
JP 2020044389 A * 3/2020
JP 2024049441 A * 4/2024
WO WO-2007102788 A1 * 9/2007 ..... A63F 5/00

* cited by examiner

*Primary Examiner* — Raleigh W Chiu
(74) *Attorney, Agent, or Firm* — Leong C. Lei

(57) ABSTRACT

A roulette device is disclosed. The roulette device comprises a housing and a top lid, wherein an inner side of the housing comprises a bottom surface, a slop portion and a cover portion. The bottom surface having a plurality of round holes arranged along the edge of the bottom surface; the slop portion being disposed to surround the edge of the bottom surface, and having a plurality of folding lines corresponding to the number of the plurality of round holes, so that a slop surface of the slop portion forms a non-curved surface; the cover portion being disposed above the slop portion, with its inner edge covering the slop portion, so that the bottom surface, the slop portion and the cover portion forms a storage space for a ball to roll inside; and the top lid can be placed above the cover portion and assembled with the housing to form a box-like structure for easy carrying.

16 Claims, 4 Drawing Sheets

ROULETTE DEVICE

BACKGROUND OF THE INVENTION

1. Field of the Invention

The present invention generally relates to a game device, in particular to a portable roulette device.

2. Description of the Related Art

The word "Roulette" was derived from French with its original meaning being a small wheel, which is a common gambling game in casinos, having a Dealer or Croupier casting a ball into a spinning roulette plate, and the number on which the ball stops is the winning number.

In all kinds of parties, it is common to play some simple games that can allow everyone to participate so as to promote communication between guests or bring up the atmosphere, and the roulette is a common and popular game to promote communication between guests where all you need is to cast a ball to start the game.

However, the general roulette devices are fixed, and a driving motor for rotating the roulette is required, so it cannot be carried around. Furthermore, although some portable roulettes have been developed, the size of which are relatively large due to the need for a driving motor, and the battery installed also results in heavier weight. Therefore, it is still inconvenient even if it is portable, and storage is also a problem considering the size.

As such, the inventors aimed to provide a roulette device to tackle the deficiencies of the known technology based on years of experience in manufacturing, development and designing of related products, so as to promote the implementation and utilization of the industry.

SUMMARY OF THE INVENTION

Therefore, it is a primary objective of the present invention to provide a roulette device which solves the deficiencies of the known technology.

To achieve the foregoing objective, the present invention provides a roulette device comprising a housing and a top lid. Wherein an inner side of the housing comprises a bottom surface, a sloped portion and a cover portion.

The bottom surface having a plurality of round holes arranged along the edge of the bottom surface.

The sloped portion being disposed to surround the edge of the bottom surface, and having a plurality of folding lines corresponding to the number of the plurality of round holes, so that a slop sloped surface of the slop sloped portion forms a non-curved surface.

The cover portion being disposed above the sloped portion, with its inner edge covering the upper side the sloped portion, so that the bottom surface, the sloped portion and the cover portion forms a storage space for a ball to roll inside.

The top lid can be placed above the cover portion and assembled with the housing to form a box-like structure for easy carrying.

When playing the roulette game, the user may cast a ball into the storage space of the roulette device, and shake the housing by hands in a clockwise or counter clockwise fashion, so the ball may spin along the surface of the slop sloped portion, then place the roulette device back to the table, and wait for the ball to decelerate and move clown to the bottom surface due to gravity and friction. The ball will eventually stop and land on one of the round holes each corresponds to a sloped surface section having a pattern or a number attached, and the participants of the game can then determine the winner according to the bet pattern or number.

While the user is holding and shaking the housing for the ball to spin, the ball could be kept inside the storage space by the inner edge of the cover portion covering the upper side of the sloped portion, so the ball doesn't fall out of the storage space under rapid shaking, and hinder the gaming experience.

After the game is over, the top lid can be placed above the cover portion and assemble with the housing to form a box-like structure for easy carrying and storage.

Preferably, the housing and the top lid are square-shaped.

Preferably, the edge length of the top lid is longer than the edge length of the housing so as to be smoothly assembled with each other.

Preferably, the number the plurality of round holes is an even number, and the plurality of folding lines corresponding to the plurality of round holes are also even number corresponding, so as to facilitate the manufacturing and assembly of the roulette device.

Preferably, the aperture of the plurality of round holes is slightly smaller than the diameter of the ball, so that the user can easily take the ball after the game is over.

The technical features of the present invention will be described in detail below with specific embodiments in conjunction with the accompanying drawings, so that those with ordinary skill in the art can easily understand the purpose, technical features, and advantages of the present invention.

BRIEF DESCRIPTION OF THE DRAWINGS

The detailed structure, operating principle and effects of the present invention will now be described in more details hereinafter with reference to the accompanying drawings that show various embodiments of the invention as follows. Obviously, the drawings described below only represent some embodiments of the present invention, and for those with ordinary skill in the art to which the present invention belongs, other embodiments can also be obtained according to these drawings.

DETAILED DESCRIPTION OF THE PREFERRED EMBODIMENTS

The technical content of the present invention will become apparent by the detailed description of the following embodiments and the illustration of related drawings. The purpose of the drawings is only for illustration and auxiliary instructions, and may not necessarily be the real proportion and precise configuration of the implementation of the present invention. Therefore, the proportion and relative configuration of the attached drawings should not be interpreted as or limiting the scope of the present invention in actual implementation.

Figure 1:
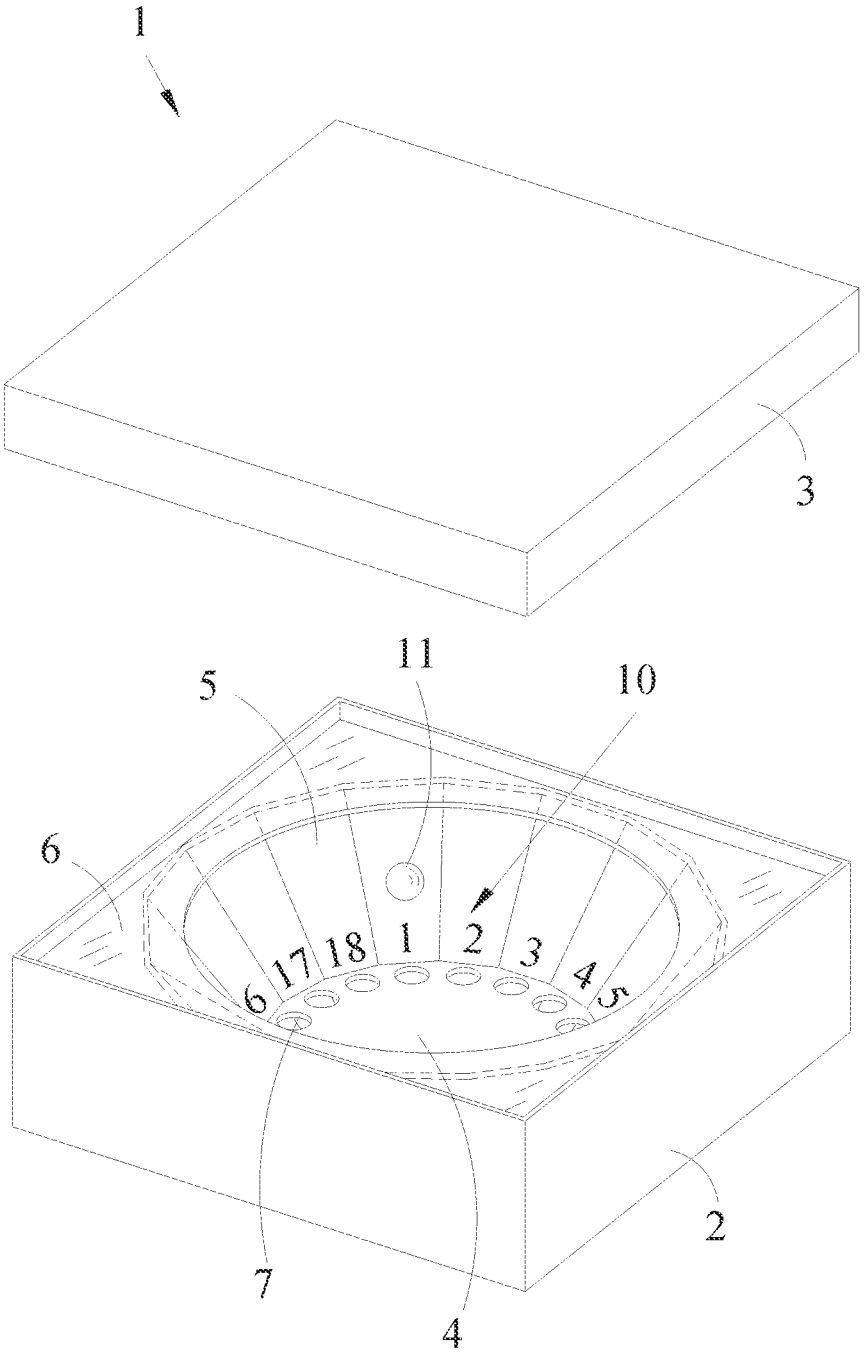
FIG. 1 is a schematic perspective view of a roulette device of the present invention.
Figure 2:
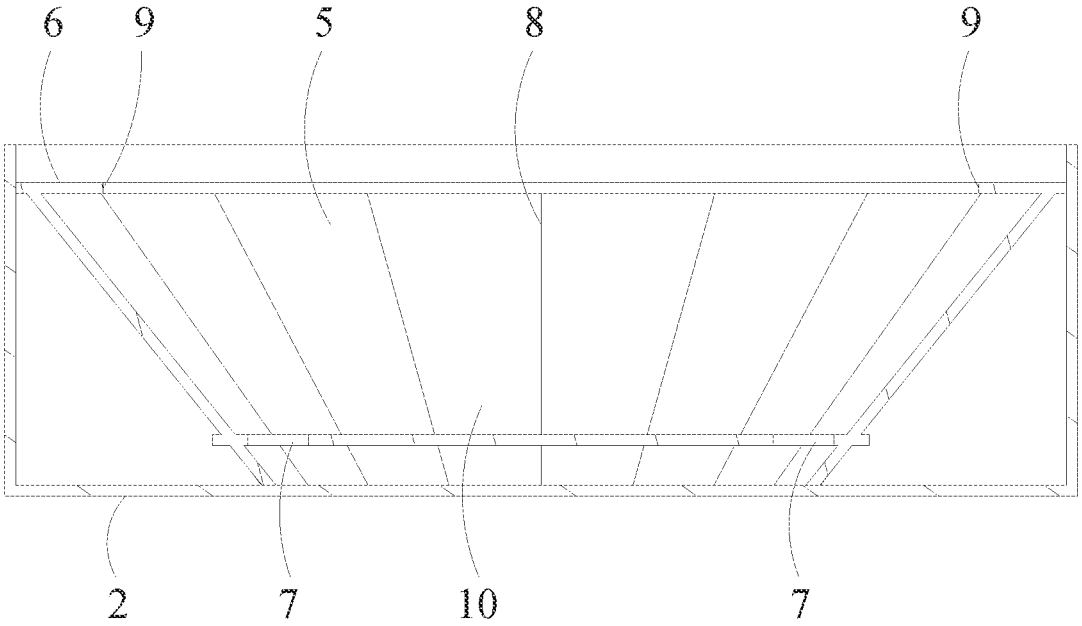
FIG. 2 is a cross-sectional view of a roulette device of the present invention.
Figure 3:
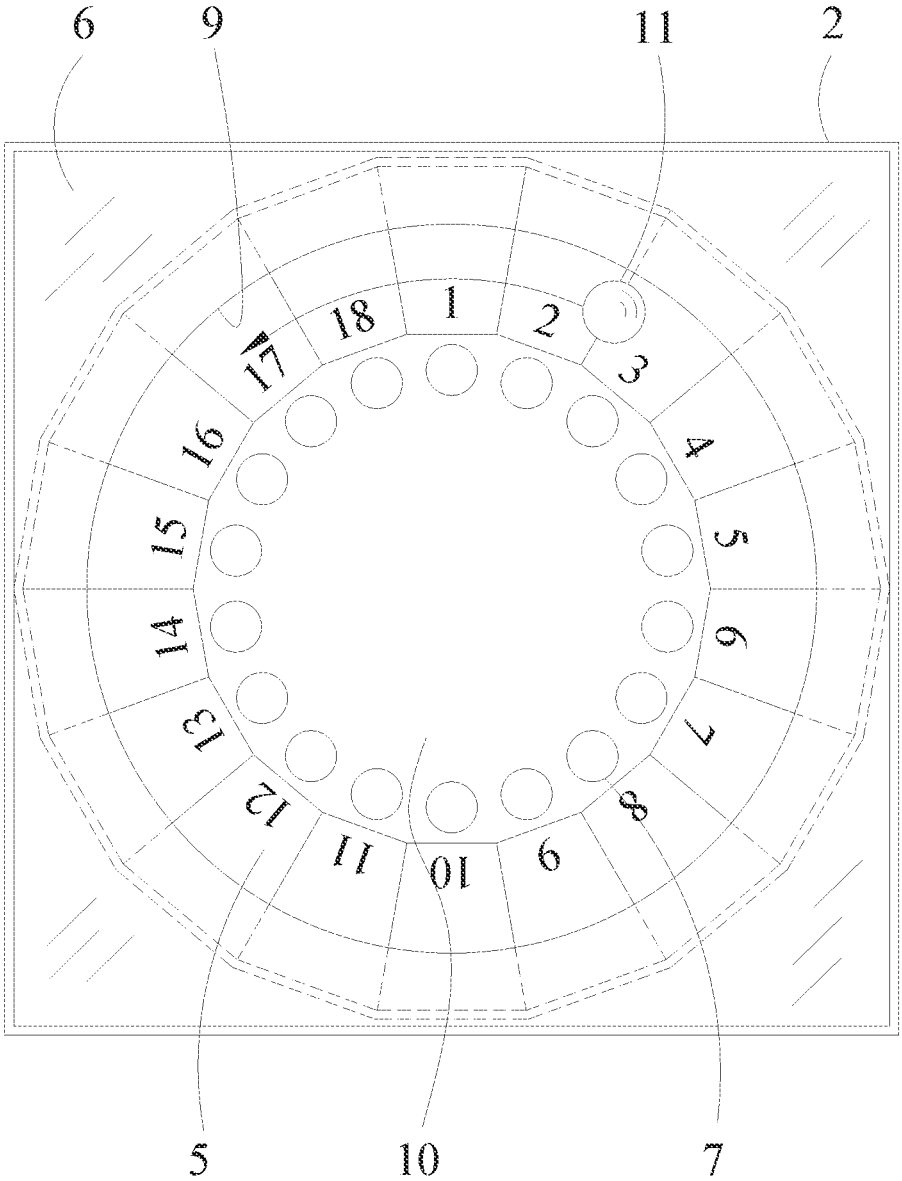
FIG. 3 is a schematic view of a roulette device of the present invention while casting a ball.
Figure 4:
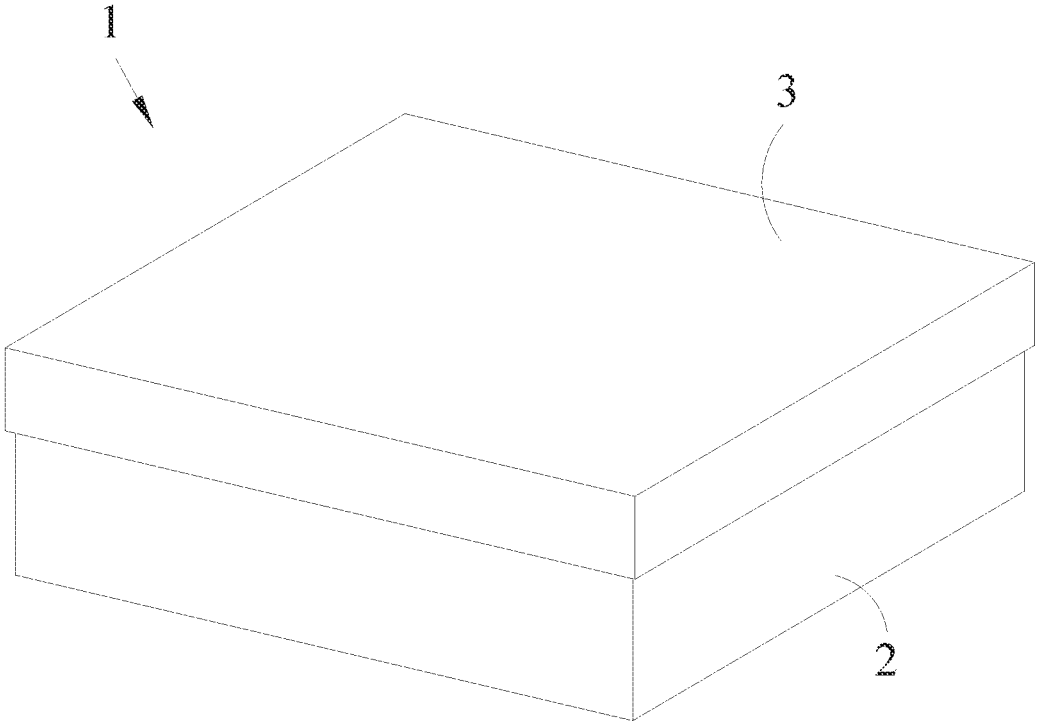
FIG. 4 is a schematic view of a roulette device of the present invention in storage.

With reference to FIG. 1 to FIG. 3, wherein FIG. 1 is a schematic perspective view of a roulette device of the present invention, FIG. 2 is a cross-sectional view of a roulette device of the present invention, and FIG. 3 is a schematic view of a roulette device of the present invention while casting a ball.

The roulette device 1 comprises housing 2 and a top lid 3, wherein an inner side of the housing 2 comprises a bottom surface 4, a sloped portion 5 and a cover portion 6.

The bottom surface 4 being disposed at the bottom side of the housing 2, while having a plurality of round holes 7 arranged along the edge of the bottom surface 4.

The sloped portion 5 being disposed to surround the edge of the bottom surface 4, and having a plurality of folding lines 8 corresponding to the number of the plurality of round holes 7, so that a sloped surface of the sloped portion 5 forms a non-curved surface. The plurality of folding lines 8 divide the slope sloped portion 5 into a plurality of sloped surface sections, so that the plurality of sloped surface sections corresponds to the plurality of round holes 7 respectively. Each of the sloped surface sections has a pattern (not shown) or number assigned thereon.

The cover portion 6 being disposed above the sloped portion 5, with its inner edge 9 covering the upper side the sloped portion 5, so that the bottom surface 4, the sloped portion 5 and the cover portion 6 forms a storage space 10 for a ball 11 to roll inside.

The top lid 3 can be placed above the cover portion 6 and can be assembled with the housing 2 to form a box-like structure.

When playing the roulette game, the user may cast the ball 11 into the storage space 10 of the roulette device 1, and shake the housing 2 by hands in a clockwise or counter clockwise fashion, so the ball 11 may spin along the surface of the sloped portion 5, then place the roulette device 1 back to the table, and wait for the ball 11 to decelerate and move clown to the bottom surface 4 due to gravity and friction. The ball 11 will eventually stop and land on one of the round holes 7 each corresponds to a sloped surface section having a pattern or a number attached, and the participants of the game can then determine the winner according to the bet pattern or number.

While the user is holding and shaking the housing 2 for the ball 11 to spin along the surface of the sloped portion 5, the ball 11 could be kept inside the storage space 10 by the inner edge 9 of the cover portion 6 covering the upper side of the sloped portion 5, so the ball 11 doesn't fall out of the storage space 10 under rapid shaking, and hinder the gaming experience.

After the game is over, the top lid 3 can be placed above the cover portion 6 and assemble with the housing 2 to form a box-like structure for easy carrying and storage.

Preferably, the housing 2 and the top lid 3 are square-shaped.

Preferably, the edge length of the top lid 3 is longer than the edge length of the housing 2 so as to be smoothly assembled with each other.

Preferably, the number the plurality of round holes 7 is an even number, and the plurality of folding lines 8 corresponding to the plurality of round holes 7 are also even number corresponding, so as to facilitate the manufacturing and assembly of the roulette device 1.

Preferably, the aperture of the plurality of round holes 7 is slightly smaller than the diameter of the ball 11, so that the user can easily take the ball 11 out after the game is over.

In summation of the description above, the roulette device of the present invention can solve the problems regarding the weight of the portable roulette, and the inconvenience to carry and store.

The above description is only exemplary, rather than limiting. Any equivalent modifications or changes that do not depart from the spirit and scope of the present invention should be included in the scope of the appended claims.

What is claimed is:

1. A roulette device, comprising a housing; and a top lid configured to be able to assemble with the housing to form a box-like structure, wherein an inner side of the housing comprises a bottom surface disposed at the bottom side of the housing, a sloped portion disposed to surround an edge of the bottom surface, and a cover portion disposed above the sloped portion;

wherein the bottom surface comprises a plurality of round holes arranged along the edge of the bottom surface; and wherein the sloped portion comprises a plurality of folding lines corresponding to a number of the plurality of round holes, so that a sloped surface of the sloped portion forms a non-curved surface.

2. The roulette device of claim 1, wherein the plurality of folding lines divide the sloped portion into a plurality of sloped surface sections, so that the plurality of sloped surface sections corresponds to the plurality of round holes respectively.

3. The roulette device of claim 2, wherein an inner edge of the cover portion covers the upper side of the sloped portion, so that the bottom surface, the sloped portion and the cover portion forms a storage space for a ball to roll inside.

4. The roulette device of claim 3, wherein the ball is kept inside the storage space by the inner edge of the cover portion covering the upper side of the sloped portion.

5. The roulette device of claim 3, wherein an aperture of the plurality of round holes is slightly smaller than a diameter of the ball.

6. The roulette device of claim 1, wherein an inner edge of the cover portion covers the upper side of the sloped portion, so that the bottom surface, the sloped portion and the cover portion forms a storage space for a ball to roll inside.

7. The roulette device of claim 6, wherein the ball is kept inside the storage space by the inner edge of the cover portion covering the upper side of the sloped portion.

8. The roulette device of claim 1, wherein an aperture of the plurality of round holes is slightly smaller than a diameter of the ball.

9. The roulette device of claim 1, wherein the housing and the top lid are square-shaped.

10. The roulette device of claim 1, wherein an edge length of the top lid is longer than an edge length of the housing so as to be smoothly assembled with each other.

11. The roulette device of claim 1, wherein an inner edge of the cover portion covers the upper side of the sloped portion, so that the bottom surface, the sloped portion and the cover portion forms a storage space for a ball to roll inside.

12. The roulette device of claim 11, wherein the ball is kept inside the storage space by the inner edge of the cover portion covering the upper side of the sloped portion.

13. The roulette device of claim 11, wherein an aperture of the plurality of round holes is slightly smaller than a diameter of the ball.

14. The roulette device of claim 1, wherein an inner edge of the cover portion covers the upper side of the sloped portion, so that the bottom surface, the sloped portion and the cover portion forms a storage space for a ball to roll inside.

15. The roulette device of claim 14, wherein the ball is kept inside the storage space by the inner edge of the cover portion covering the upper side of the sloped portion.

16. The roulette device of claim 14, wherein an aperture of the plurality of round holes is slightly smaller than a diameter of the ball.

* * * * *